United States Patent [19]

Norris

[11] 4,222,655

[45] Sep. 16, 1980

[54] COMPACT PORTABLE DARKROOM

[76] Inventor: John T. Norris, 2810 DuPont Cir., Richmond, Va. 23222

[21] Appl. No.: 41,046

[22] Filed: May 21, 1979

Related U.S. Application Data

[63] Continuation-in-part of Ser. No. 956,696, Nov. 1, 1978, abandoned.

[51] Int. Cl.[3] ..... G03D 13/00

[52] U.S. Cl. ..... 354/308; 355/21; 355/27

[58] Field of Search ..... 354/187, 226, 250, 288, 354/297, 307, 308, 309, 315; 355/78, 21, 27, 28, 29, 113

[56] References Cited

U.S. PATENT DOCUMENTS

| | | | |
|---|---|---|---|
| 435,342 | 8/1890 | Blackmore | 354/308 |
| 617,017 | 1/1899 | Harrison | 354/308 |
| 684,803 | 10/1901 | Dunscomb | 354/307 |
| 779,748 | 1/1905 | Stevenson et al. | 354/308 |
| 929,807 | 8/1909 | Willyerd | 354/308 |
| 1,233,441 | 7/1917 | Benko | 354/309 |
| 1,821,129 | 9/1931 | Weisker | 354/307 |
| 2,484,048 | 10/1949 | Powers et al. | 354/309 |
| 2,789,490 | 4/1957 | Kaufman | 354/187 |
| 3,811,767 | 5/1974 | Purnell | 355/27 |
| 4,026,649 | 5/1977 | Leonhart | 355/27 |

FOREIGN PATENT DOCUMENTS

| | | | |
|---|---|---|---|
| 548725 | 1/1923 | France | 354/308 |

*Primary Examiner*—L. T. Hix
*Assistant Examiner*—Alan Mathews
*Attorney, Agent, or Firm*—Norman B. Rainer

[57] ABSTRACT

A darkroom assembly comprised of a shell consisting of six interconnected rectangular panels formed into a box encloses suitably arranged apparatus and chemicals for making contact and enlarged photographic prints, and further incorporates the features of a pin hole camera. By virtue of the combination of an internally housed safe light and a viewing lens in the upper panel mounted above a red filter window, the operator can observe phenomena within the darkroom. Manipulations within the darkroom are achieved by insertion of the operator's hands through light-tight openings in the opposed side panels of the darkroom. For purposes of storage or shipping, the relative positions of the six panels may be adjusted so as to produce a collapsed structure occupying less space than the erected darkroom.

5 Claims, 12 Drawing Figures

COMPACT PORTABLE DARKROOM

This application is a continuation-in-part of application Ser. No. 956,696, filed Nov. 1, 1978 by the same inventor, now abandoned.

BACKGROUND OF THE INVENTION

1. Field of the Invention

This invention relates to an improvement in a portable darkroom capable of accommodating several photographic operations under light-proof conditions.

2. Discussion of the Prior Art

In photographic processes wherein durable pictures are created from light images, the various manipulative steps necessary in arriving at the final picture must be conducted in the absence of extraneous light that would affect the light-sensitive photographic materials. It is common practice to cause the image to be recorded by means of a camera initially on a film to form a "negative" capable of transmitting light in amounts controlled by the image intensity. Prints are produced in either contact or enlarged size by transmitting light through a negative and causing said transmitted light to impinge upon light-sensitive paper. Such operation must be done in an area where light other than that transmitted through the negative must be excluded. An exception however, is light from a "safe-light" whose wavelength, while not affecting the film, permits visual observation. The thus exposed paper is then treated with a developing medium under the same light-free conditions. Following development and fixing, the print may then be exposed to light without harm.

The foregoing procedures are generally accomplished in what is termed a darkroom, that is to say, a fixed, enclosed area, generally a room from which all outside light can be excluded. With the necessity for the required equipment, chemicals, paper, etc., the darkroom requires a considerable amount of space. It is generally impractical, particularly for non-professional photographers, to set aside such space for this purpose alone.

Professional photographers, whose work frequently takes them far from their establishments, find themselves hampered by having to delay processing of their work until they return to their regular darkrooms. In such instances a portable, and preferably collapsible darkroom is found invaluable. In the teaching of basic principles of photography, small, portable darkrooms are useful instructional devices, particularly when the student can look into the darkroom to observe actual stages of photographic processing.

Portable darkrooms of the prior art include designs, which, when deployed in their erected and assembled state are large enough to accommodate the photographer. Smaller darkrooms such as those disclosed in U.S. Pat. Nos. 684,803; 779,748; 929,807; 1,233,441; and 2,484,048 permits the photographer to insert his hands and arms into the interior region of the darkroom to carry out the requisite manipulations. Such smaller darkrooms however, generally cannot accommodate an enlarger apparatus, thereby imposing a severe limitation upon the capabilities of the darkroom.

It is accordingly the principal object of this invention to provide a compact darkroom enclosure permitting entrance by the photographer's hands and arms and small enough so that all features of the darkroom are accessible to the photographer's hands, said darkroom having the capability of producing enlarged prints.

Another important object of this invention lies in the provision of a darkroom as above described wherein the photographer can see into the darkroom to observe actual stages of photographic processing.

A further important object of this invention lies in the provision of a darkroom as above described wherein said darkroom can perform the function of a camera.

Still another important object of this invention lies in the provision of a collapsible darkroom as above described, which is inexpensive to manufacture and which can be quickly and easily assembled from component parts that occupy less space than the assembled darkroom.

These and other salient objects, advantages and functions of this invention, together with its novel features of construction, composition and arrangement of parts, will become more readily apparent from an examination of the following description.

SUMMARY OF THE INVENTION

The objects of the present invention are accomplished in general by the provision of a darkroom assembly having an outer shell comprised of six flat rectangular panels interengaged to form a box-like enclosure. Of the six panels, four serve as the vertical panels of a box, one serves as the top of the box, and one panel serves as the bottom of the box. Two diametrically opposed vertical panels, serving as the left and right sides of the box are each provided with holes large enough to permit insertion of the operator's hands. A lightproof flexible sleeve attached to each hole and disposed on the outer face of each of said side panels excludes light from said box when the operator's hands are inserted through said sleeves and into said box. The third vertical panel serves as the rear panel of the box, and is provided with fittings capable of supportively positioning an enlarging easel. The fourth vertical panel, serving as a front panel, is hingedly attached to a forward edge of the other panels, and facilitates access into said enclosure. The top panel is provided with a centrally positioned sight hole equipped with a substantially fixed window which permits passage of only red light, and a second sight hole located adjacent the portion of said box intended to accommodate said enlarging easel, said second sight hole being equipped with a removeable window which allows passage of only red light and further equipped with means to facilitate lightproof coupling to the lens of an enlarger, not a part of this invention.

The box-like darkroom enclosure is adapted to functionally accommodate three trays containing processing chemicals, a safe-light, a contact printer, and a lightproof compartment for the storage of photographic paper.

In a preferred embodiment of the darkroom enclosure assembly, the rear panel of the box is provided with a small aperture which serves as a pin hole lens. A flat film-holding surface is vertically disposed within the box opposite said pin hole lens.

In a further preferred embodiment, the six panels are adapted to reversibly interengage whereby, in the disengaged or storage mode, the panels occupy less space than when in the deployed or assembled mode represented by the erected box-like darkroom enclosure. Said preferred embodiment is referred to hereinafter as a collapsible construction.

BRIEF DESCRIPTION OF THE DRAWINGS

In the accompanying drawing forming a part of this specification and in which similar numerals of reference indicate corresponding parts in all the figures of the drawing.

DESCRIPTION OF THE PREFERRED EMBODIMENTS

Figure 1:
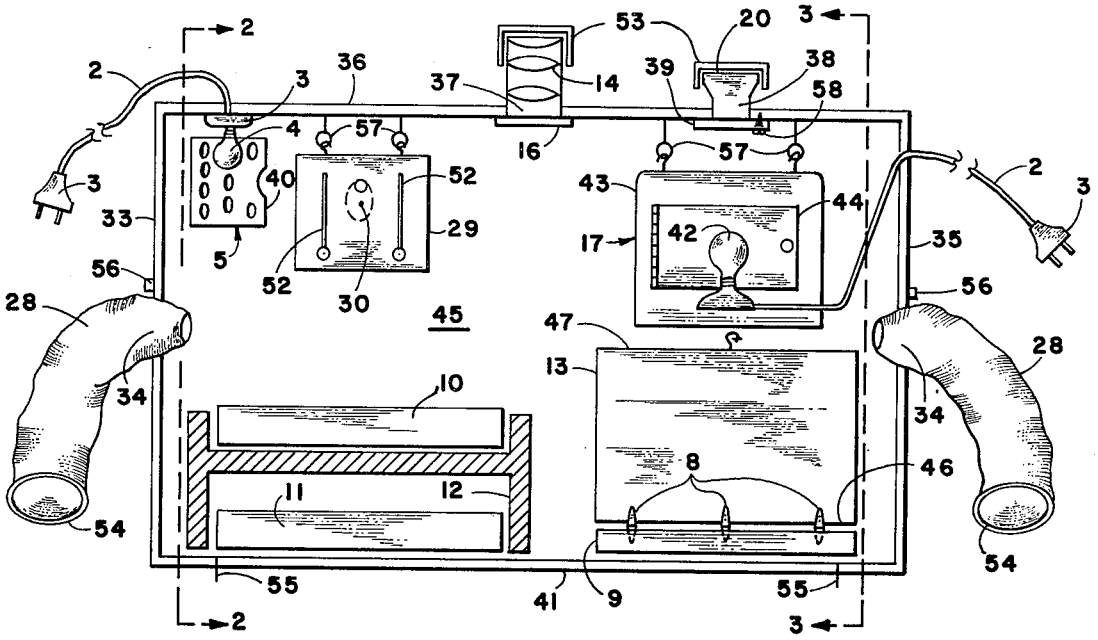
FIG. 1 is a front elevational view of an embodiment of the darkroom enclosure assembly of the present invention with the front panel removed.
Figure 2:
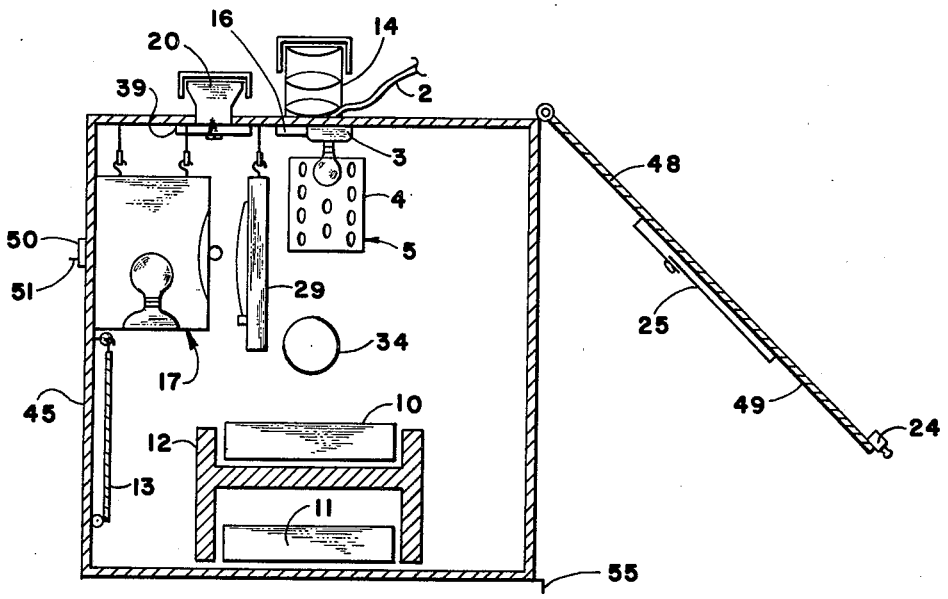
FIG. 2 is a vertical sectional view taken substantially upon the plane indicated by section line 2—2 of FIG. 1, and with the front panel shown in a partially raised position.

Referring now specifically to FIG. 1, illustrating an embodiment of the darkroom enclosure assembly of the present invention in the deployed erected configuration, left side panel 33 containing centrally located aperture 34 and associated flexible sleeve 28 is positioned opposite and spaced apart from right side panel 35 containing the substantially identical aperture 34 and sleeve 28. The top panel 36, horizontally disposed between side panels 33 and 35, is provided with a centrally located viewing port 37, above which is mounted a viewing lens assembly 14, and below which is mounted a substantially fixed window 16 which permits passage of essentially only red light. A removeable opaque cap 53 is positioned atop lens assembly 14 when said assembly is not is use. Aperture 38 located to the right of viewing port 37 in top panel 36 is provided with a removeable window 39 having light transmission characteristics similar to those of window 16. Window 39 is adapted to be pivoted horizontally about attachment screw 58 in a manner so as not to occlude aperture 38. A flexible adapter 20 positioned above aperture 38 is designed to form a light-tight coupling with the projecting lens of a photographic enlarger, not shown. Said adapter is of conical configuration and fabricated of sufficiently compliant soft flexible material to facilitate a snug fit with the lens of an enlarger. Said adapter is attached to top panel 36 preferably be releasible means such as snap fasterers, Velcro bindings, a press-fit coupling, or equivalent means. A removeable opaque cap 53 is positioned atop adapter 20.

A safe-light assembly 5 removeably attached to top panel 36 is comprised of a bulb 4 which emits essentially only red light, a perforated cylindrical metal shade 40 rotatable about bulb 4 in a manner to control the amount of light directed toward the interior of the box, an electrical socket 3 having means for removeable attachment to top panel 36, and an electrical cord 2 attached to socket 3 and passing through an opening in top panel 36.

A tray 9, intended to contain developer solution, is positioned on the right side of the box, resting on bottom panel 41. A tray 10, intended to contain chemicals to stop the development action, is seated on removeable table 12. Tray 11, intended to contain fixer chemicals which remove unreacted light sensitive materials from photographic paper, rests on bottom panel 41 and is positioned beneath tray 10 and within the confines of table 12.

A contact printing assembly 17, of ordinary design, is removeably attached by hook and eye combinations 57 to upper panel 36 generally below aperture 38. The contact printing assembly comprises a bulb 42 within an enclosure 43 having a door 44 which will hold a negative and print paper in flat uniform contact. Bulb 42, which emits white light, is electrically connected to electrical cord 2 which extends through a hole in right side panel 35 and may be provided with a conventional in-line on-off switch.

A pin hole aperture 30 is located in rear panel 45 between viewing port 37 and safelight assembly 5. Vertically positioned film holder 29, pendant from top panel 36, is centered on a horizontal line going through pin hole aperture 30 and perpendicularly intersecting the forward flat surface of said film holder.

Figure 3:
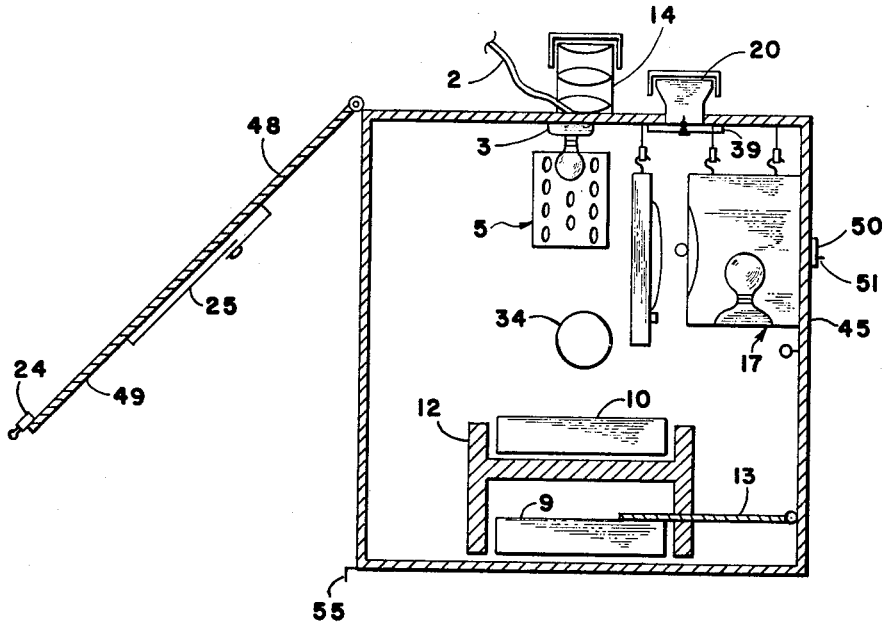
FIG. 3 is a vertical sectional view taken substantially upon the plane indicated by section line 3—3 of FIG. 1, but with the enlarging easel component in its functional downward position.

A flat rectangular easel 13 is attached at its lowermost edge 46 by hinges 8 to rear panel 45. The uppermost edge 47 of easel 13 is adjustably fastened to rear panel 45, both lowermost and uppermost edges to easel 13 being parallel to top panel 36. The height of easel 13 between uppermost edge 47 and lowermost edge 46 is such as to extend to tray 9 and rest on the top rim thereof for support. As shown more clearly in FIG. 3, when easel 13 is in its downward functional position, it is supported in a horizontal plane by abutment with the upper rim of tray 9. The dimensions and positioning of easel 13 are therefore critically selected so as to achieve the desired mode of function.

Front panel 48, hingedly attached at its uppermost edge to the front edge of top panel 36, contains on its inner surface 49 a light-proof pocket 25 for the storage of photographic paper. Spring fasteners 24 on the lowermost edge of front panel 48 engage with holders 55 in the forward edge of bottom panel 41 to facilitate the closing and opening of the deployed darkroom structure.

The six panel members are fabricated of rigid lightweight material such as plywood. The interior surfaces of the panels preferably have a dull black non-reflective coating. The panels are adapted to be interconnected at their abutment edges by either permanent or reversible joining means. The front panel, however is hingedly connected to any of the forwardly disposed edges of the top, bottom and side panels, and preferably connected to the forwardly disposed edge of said top panel. The hinged attachment of the front panel provides access into the darkroom enclosure for the insertion or removal of trays and photographic paper.

Except for the hingedly moveable nature of the front panel, the remaining five panels may be immoveably and durably interconnected as by adhesives, riveting, stapling or other well known equivalent means. However, it is preferred that the panels by interconnected in a manner which permits their readjustment to a collapsed structure occupying less space than the erected darkroom. To achieve this feature, the panels may be interengaged by means which either permit motion or permit repeated assembly and disengagement. Suitable engagement means which permit motion include hinge means such as piano-type and fabric-based hinges. Such hinges may be attached by adhesives or equivalent means to the appropriate edges of the panels. Suitable engagement means which permit repeated assembly and disengagement are separable fasteners such as zippers, Velcro binders and the like, and pressure-sensitive adhesive tape. The Velcro binders, made by the Velcro Corp. of N.Y., are comprised of a fabric layer having flexible loop or hook projections, and an interactive second fabric layer having flexible loop or hook projections. At all six edges of the assembled enclosure, light excluding means are provided such as opaque fabric linings, felt-lined baffles, or other equivalent means.

Figure 8:
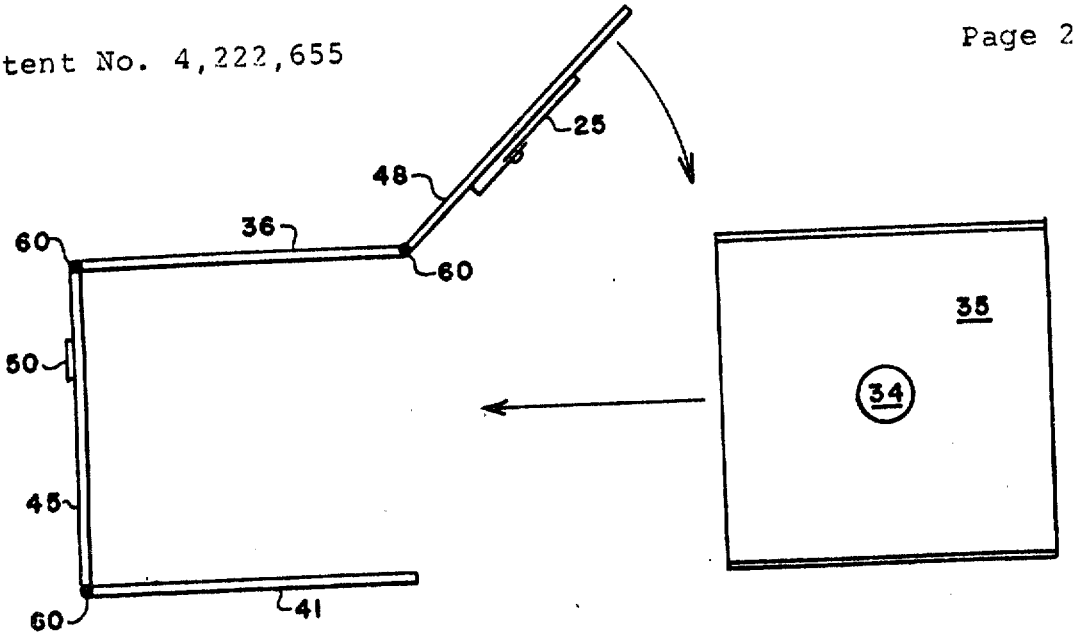
FIG. 8 is a sectional side view taken in the same mode as FIG. 2, showing only the outer shell of a darkroom comprised of hingedly interengaged panels.
Figure 9:
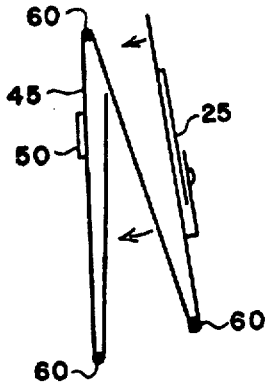
FIG. 9 shows a portion of the outer shell of the darkroom of FIG. 8 in a partially folded state.
Figure 10:
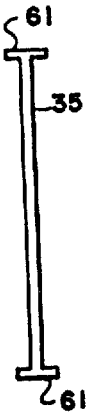
FIG. 10 is a vertical sectional view of a side panel of the outer shell of the darkroom of FIG. 8.
Figure 11:
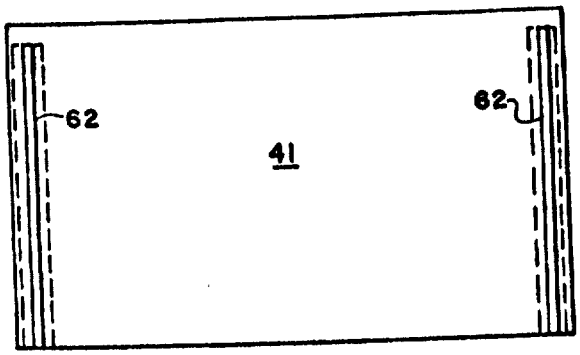
FIG. 11 is a plan view of the bottom panel of the outer shell of the darkroom of FIG. 8.

FIG. 8 shows an embodiment of outer shell wherein front panel 48, top panel 36, rear panel 45 and bottom panel 41 are interconnected by piano hinges 60. Side panel members 35 and 33 (not shown) are adapted to engage top panel 36 and bottom panel 41 by means of T-footings 61 shown in FIG. 10 adapted to fit within grooves 62 disposed at each end of upper panel 36 and lower panel 41, as shown in FIG. 11. By virtue of the hinged construction of the embodiment of FIG. 8, the outer shell can be collapsed to a compactly folded storage mode configuration, as shown in FIG. 9.

Figure 12:
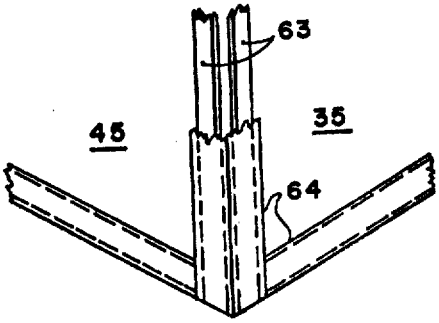
FIG. 12 is an enlarged fragmentary perspective view of an embodiment of outer shell of the darkroom enclosure interengaged by Velcro fastener means.

The use of Velcro binders in joining the panels of the outer shell is shown in FIG. 12 wherein a wide outer band 64 having hook-like projections on its inner face, is folded around the intersection of the panels and made to overlap and engage with separate narrow bands 63 adhered to said panels and having hook or loop-like projections on their outer faces.

In order to enable the operator to insert his hands into opposite sides of the box and simultaneously look through lens 14, the dimensions of the box are critical. A height of between 11 and 13 inches has been found suitable, and a width, measured between side panels 33 and 35, of between 15 and 17 inches has been found suitable.

The viewing lens 14 preferably provides an angle of view within the box much larger than could be realized by merely looking into the box without the aid of any lens. Such lens system may be designated a concave or image-reducing lens system.

Sleeve members 28 may be comprised of a long flexible fabric sleeve, the innermost end of which preferably terminating within the box and having a constrictive portion such as an elastic band which will form a tight fit about the operator's arms. The outermost end of each sleeve member 28 is preferably provided with a weighted metal ring 54 whose function is to keep the sleeves in a downward position when not in use, thereby insuring the exclusion of light from apertures 34. When the box is collapsed in preparation for its storage or transportation, the rings 4 may be secured by magnet holders 56 or other equivalent means located on the side panels adjacent apertures 34.

The means utilized to removeably position the safe light assembly 5, contact printer assembly 17, and film holder 29, may be ordinary hook and eye devices or equivalent means of simple and compact design. Preferably, flush-mounted or recessed mounting means are utilized for all components which engage the panels of the outer shell. In this manner, the panels are better adapted to lie close together in the collapsed or storage mode of the outer shell. Such mounting means may involve snap fasteners, Velcro bindings, press-fit couplings, contact adhesive surfaces, and equivalent means.

Figure 5:
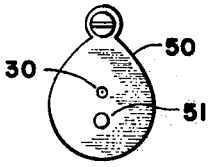
FIG. 5 is a front view of the pin hole lens feature of FIG. 4.
Figure 4:
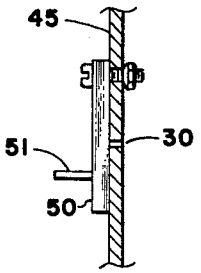
FIG. 4 is an enlarged sectional side view of the pin hole lens feature of FIG. 1.
Figure 7:
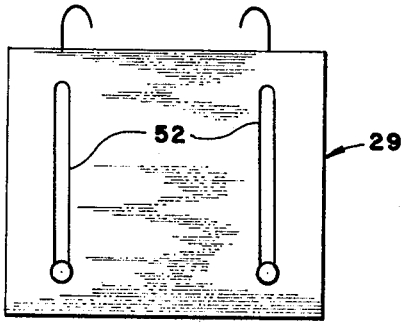
FIG. 7 is a front view of the film-holding means of FIG. 6.
Figure 6:
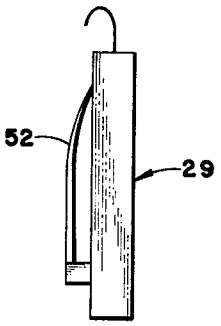
FIG. 6 is an enlarged side view of the vertically disposed film-holding means of FIG. 1.

The pin hole aperture 30 is of round configuration, having a diameter of about 1 millimeter. As shown in FIGS. 4 and 5, an adjustable cover 50 manually positionable by means of handle 51 is utilized to occlude the pin hole, thereby functioning as the shutter of a camera. To operate the pin hole camera feature of this invention, a piece of flat sheet film is positioned on film holder 29 by means of spring clips 52, the box is aimed at a brightly illuminated subject, and the cover 50 is raised to cause an image to impinge upon the film. The required duration of exposure of the film may range from about one to four minutes. The exposed film is then removed from the holder and immersed sequentially in developer, short-stop and fixer solutions within the box. The combination of the pin hole camera feature of the present invention in association with the film developing capability and provision for viewing the overall process constitutes a system for teaching the fundamentals of photography.

When the apparatus is utilized to produce photographic prints which are enlarged from a negative, a standard photographic enlarger is employed and its projecting lens is fitted into adapter 20. The contact printer assembly 17 is removed from the box, window 39 is removed or displaced, and easel 13 is lowered to its horizontal position. Photographic paper is taken from pocket 25, clipped to easel 13, and exposed to the image projected by the enlarger. Processing of the exposed photographic paper follows the same sequence as aforementioned with respect to processing of film.

To prepare the darkroom apparatus for storage, the components normally contained within the darkroom enclosure are removed, and the six panels are either disengaged or pivoted about their hinges so that they can be arranged in a reasonably flat compact configuration.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

What is claimed is:

1. A darkroom assembly comprised of a shell consisting essentially of six flat rectangular panels interconnected and dimensioned in a manner permitting erection of a box-like enclosure wherein four of said panels serve as the vertical panels of said box, a fifth panel serves as the top of said box, and the sixth panel serves as the bottom of said box, a first and second of said vertical panels being spaced apart in parallel planes and serving as the left and right side panels of said box, each of said side panels being provided with holes large enough to permit insertion of the operator's hands, a lightproof flexible sleeve attached to each of said holes and generally disposed on the exterior of said box, the third vertical panel serving as the rear panel of said box and supporting a rectangular enlarging easel by hinged engagement with the horizontally aligned lower edge of said easel (thereof), the fourth vertical panel serving as the front panel of said box and hingedly engaged at one edge to the forwardly disposed edge of another panel, said top panel being provided with a centrally positioned sight hole equipped with a concave lens and associated filter window, and a second sight hole in said top panel located adjacent the portion of said box having said enlarging easel, said second sight hole being equipped with a moveable filter window and flexible adapter means to facilitate light-proof coupling to an enlarger lens, said assembly including (box functionally accommodating) three trays for confinement of photographic chemicals, a safelight, a contact printer, and a compartment for the storage of light-sensitive photographic sheet material, said trays, safelight, contact printer and compartment being adapted for functional accommodation within said box-like enclosure.

2. The darkroom assembly of claim 1 wherein said shell is of a collapsible construction permitting disassembly to a storage mode which occupies less space than the assembled shell in its erected state.

3. The darkroom assembly of claim 1 wherein said rear panel contains a pin hole aperture and associated closure means, and said top panel pendantly supports a film holding means aligned such that a horizontal line through said aperture perpendicularly intersects the center of said film holding means.

4. The darkroom assembly of claim 1 wherein said enlarging easel, in its functional mode, is supported in a horizontal plane by abutment with an upper portion of one of said trays within said enclosure.

5. The darkroom assembly of claim 1 wherein the upper edge of said front panel hingedly engages the front edge of said top panel.

* * * * *

UNITED STATES PATENT AND TRADEMARK OFFICE

CERTIFICATE OF CORRECTION

PATENT NO. : 4,222,655

DATED : September 16, 1980

INVENTOR(S) : John T. Norris

It is certified that error appears in the above—identified patent and that said Letters Patent is hereby corrected as shown below:

The attached sheet of drawing consisting of Figs. 8-12 should be added as part of the above-identified patent.

Signed and Sealed this

*Fourteenth* Day of *April 1981*

[SEAL]

*Attest:*

RENE D. TEGTMEYER

*Attesting Officer*

*Acting Commissioner of Patents and Trademarks*